US011295698B2

(12) United States Patent
Wang et al.

(10) Patent No.: US 11,295,698 B2
(45) Date of Patent: Apr. 5, 2022

(54) CONNECTOR FOR DISPLAY DEVICE AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Jianting Wang, Beijing (CN); Rui Guo, Beijing (CN); Hao Zhou, Beijing (CN); Boxiao Lan, Beijing (CN); Jianzi He, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 469 days.

(21) Appl. No.: 16/338,637

(22) PCT Filed: Oct. 18, 2018

(86) PCT No.: PCT/CN2018/110829
§ 371 (c)(1),
(2) Date: Apr. 1, 2019

(87) PCT Pub. No.: WO2019/205514
PCT Pub. Date: Oct. 31, 2019

(65) Prior Publication Data

US 2021/0327391 A1 Oct. 21, 2021

(30) Foreign Application Priority Data

Apr. 27, 2018 (CN) ..... 201810394645.6

(51) Int. Cl.
*G09G 5/00* (2006.01)

(52) U.S. Cl.
CPC ..... *G09G 5/006* (2013.01); *G09G 5/005* (2013.01)

(58) Field of Classification Search
CPC ..... G09G 5/006; G09G 5/005; G09G 3/2092; G09G 2330/027; H04N 5/44; G06F 1/266
See application file for complete search history.

(56) References Cited

U.S. PATENT DOCUMENTS 10,416,715 B1 * 9/2019 Wade ..... G06F 1/266
2003/0014766 A1 * 1/2003 Dinwiddie ..... H04N 21/43615 725/126

(Continued)

FOREIGN PATENT DOCUMENTS

CN 1496114 5/2004
CN 101287076 10/2008

(Continued)

OTHER PUBLICATIONS

International Search Report and Written Opinion of the International Searching Authority (with English language translation of the Written Opinion), International Application No. PCT/CN2018/110829, dated Jan. 30, 2019, 14 pages.

(Continued)

*Primary Examiner* — Abbas I Abdulselam
(74) *Attorney, Agent, or Firm* — Myers Bigel, P.A.

(57) ABSTRACT

Embodiments of the present disclosure provide a connector for a display device and a relevant display device. The connector includes an input cable interface for connecting an input cable to receive an input mixed signal, a signal processor for processing a first signal in the mixed signal received via the input cable interface to obtain a video signal for display, a signal separator for separating a second signal from the mixed signal and to generate a DC voltage based on the second signal, a video signal output interface for connecting a display interface of the display device to output (Continued)

the video signal, and a power output interface for connecting a power supply interface of the display device to output the DC voltage generated by the signal separator to the display device. Externally-connection interfaces and connection wires are reduced by using one cable to transmit signals of multiple properties.

17 Claims, 2 Drawing Sheets

(56) References Cited

U.S. PATENT DOCUMENTS

| | | | | |
|---|---|---|---|---|
| 2004/0085480 | A1 | 5/2004 | Salzer et al. | |
| 2007/0256105 | A1* | 11/2007 | Tabe | G08B 25/085 725/78 |
| 2008/0001945 | A1 | 1/2008 | Kashito et al. | |
| 2010/0175097 | A1 | 7/2010 | Zhang | |
| 2011/0179456 | A1* | 7/2011 | Bar-Niv | H04N 7/106 725/85 |
| 2013/0054842 | A1* | 2/2013 | Overby | G09G 5/008 710/5 |
| 2015/0012673 | A1* | 1/2015 | Chang | G06F 13/4022 710/19 |
| 2016/0274856 | A1 | 9/2016 | Liu et al. | |
| 2019/0286404 | A1* | 9/2019 | Momose | G06F 3/1446 |

FOREIGN PATENT DOCUMENTS

| | | |
|---|---|---|
| CN | 101426120 | 5/2009 |
| CN | 201281931 | 7/2009 |
| CN | 101989416 | 3/2011 |
| CN | 202075963 | 12/2011 |
| CN | 102883198 | 1/2013 |
| CN | 202652431 | 1/2013 |
| CN | 203243450 | 10/2013 |
| CN | 103390396 | 11/2013 |
| CN | 203661190 | 6/2014 |
| CN | 204069169 | 12/2014 |
| CN | 205647521 | 10/2016 |
| CN | 108376538 | 8/2018 |
| KR | 100255778 | 5/2000 |

OTHER PUBLICATIONS

First Office Action and English language translation, CN Application No. 201810394645.6, dated Jun. 14, 2009, 23 pages.

* cited by examiner

CONNECTOR FOR DISPLAY DEVICE AND DISPLAY DEVICE

CROSS REFERENCE TO RELATED APPLICATIONS

The present application is a 35 U.S.C. 371 national stage application of PCT International Application No. PCT/CN2018/110829, filed on Oct. 18, 2018, which claims the benefit of Chinese Patent Application No. 201810394645.6 filed on Apr. 27, 2018, the contents of which are incorporated herein by reference in their entireties.

FIELD

The present disclosure relates to the field of display, and particularly to a connector for a display device and a display device.

BACKGROUND

In the field of display, especially in the field of commercial display (digital signage, building display, indoor advertising display, traffic display, public display, etc.), display technologies employed currently include liquid crystal display, OLED (Organic Light-Emitting Diode) display, small pitch LED (Light-Emitting Diode) display, projection display and so on. Since a display device generally comprises a power supply portion, a signal receiving and processing portion, a timing control (T-CON) portion, a backlight driving portion and the like, it is difficult for a product to be made as a thin and light display and is inconvenient for the product to be installed in a narrow space or a specific space (e.g., an elevator car). At the same time, since the display device usually further requires a power supply socket (AC 220V or 380V) at a short distance, wiring reconstruction needs to be performed on many occasions. Furthermore, since high-quality video signals need to be provided to the display device, it is often necessary to employ signal lines with high data transmission rates. However, the transmission distance of existing signal lines is short, which causes difficulty in installing the display device on some specific occasions, for example areas such as outdoor, high altitude and corners. All of these bring about construction inconvenience and increase in cost.

At the same time, in some specific areas such as high-altitude and subway interior walls, the display device currently uses a memory card (such as SD/mini SD/CF card etc.,) to store the content to be played, and display control such as playing, switching, and left and right mirroring of the content is achieved through a RS232/485 interface by setting address bits for each display device. This makes replacement and update of the content troublesome and causes a high failure rate.

SUMMARY

Embodiments of the present disclosure provide a connector for a display device and a display device.

In one aspect, an embodiment according to the present disclosure provides a connector for a display device. The connector comprises an input cable interface, a signal processor, a signal separator, a video signal output interface and a power output interface. The input cable interface is configured to connect an input cable to receive an input mixed signal. The signal processor is configured to process a first signal in the mixed signal received via the input cable interface to obtain a video signal for display by the display device. The signal separator is configured to separate a second signal from the mixed signal received via the input cable interface and to generate a DC voltage based on the second signal. The video signal output interface is configured to connect a display interface of the display device to output the video signal obtained by the signal processor to the display device. The power output interface is configured to connect a power supply interface of the display device to output a DC voltage generated by the signal separator to the display device.

In some embodiments, the first signal further comprises a control signal for controlling display of the display device. The signal processor is further configured to process the first signal to separate the video signal from the control signal.

In some embodiments, the first signal comprises a modulated data signal. The signal processor comprises a DC isolation circuit, a high pass filter and a demodulator. The DC isolation circuit is configured to isolate the DC signal in the mixed signal from the input cable interface to separate the modulated data signal therefrom. The high pass filter has a low-impedance conduction characteristic for the frequency of the modulated data signal and is configured to perform high pass filtering on the separated modulated data signal. The demodulator is configured to demodulate the high-pass filtered modulated data signal. Optionally, the data signal may be an encoded video signal. The signal processor also comprises a decoder for decoding the demodulated data signal to obtain the video signal.

In some embodiments, the signal separator comprises a low pass filter for separating a DC component from the mixed signal to supply a DC voltage to the display device via the power output interface.

In some embodiments, the video signal is a fixed-format video signal. The video signal output interface comprises a low voltage differential signaling (LVDS) interface which is configured to output the fixed-format video signal directly to a driving circuit of the display device.

In some embodiments, the video signal is a variable-format video signal. The video signal output interface comprises a high definition multimedia interface (HDMI) interface which is configured to output the variable-format video signal to the display device.

In some embodiments, the connector further comprises a modulator. The modulator is configured to remodulate the data signal demodulated by the demodulator. A cascade cable interface is used to connect another cable to output the remodulated data signal to another display device.

In some embodiments, an electrical cable is a CAT-5 or CAT-6 twisted pair.

In some embodiments, the video signal is an uncompressed video signal.

In another aspect, an embodiment according to the present disclosure provides a display device. The display device comprises a driving circuit, a display panel, a power supply circuit, an input cable interface, a signal processor and a signal separator. The input cable interface is configured to connect an input cable to receive an input mixed signal. The signal processor is configured to process a first signal in the mixed signal received via the input cable interface to obtain a video signal for display by the display device. The signal separator is configured to separate a second signal from the mixed signal received via the input cable interface and to generate a DC voltage based on the second signal. The driving circuit receives the video signal from the signal processor and generates a driving signal for display of a display panel based thereon. The power supply circuit receives the DC voltage generated by the signal separator and transforms the DC voltage to supply power to the display device.

In a further aspect, an embodiment according to the present disclosure provides a display device. The display device comprises a driving circuit, a display panel, a power supply circuit and a connector as described above and elsewhere herein. The driving circuit receives a video signal from the video signal output interface and generates a driving signal for display of the display panel based thereon. The power supply circuit receives a DC voltage supplied by the power output interface and transforms the DC voltage to supply power to the display device.

In embodiments of the present disclosure, it is possible to, by extending the transmission distance of the video signal line and reducing the display device's externally-connection interfaces and connection wires, simplify the installation of the display device, reduce the construction difficulty, and improve the efficiency of later operation and maintenance.

BRIEF DESCRIPTION OF THE DRAWINGS

The above and additional objects, features and advantages of the disclosed embodiments will be better understood from illustrative and non-restrictive detailed description of embodiments of the present disclosure with reference to drawings.

All figures are schematic and are not to scale, and generally only show parts necessary to illustrate the disclosure, and other parts might be omitted or merely implied.

DETAILED DESCRIPTION

In the following description, for purposes of illustration and not limitation, some specific details such as system structures, interfaces and techniques of disclosed embodiments are stated to facilitate clear and thorough understanding of the present disclosure. However, those skilled in the art should appreciate that, without seriously departing from the spirit and scope of the present disclosure, the present disclosure may be implemented according to other embodiments which do not precisely comply with details stated in the text herein. In addition, in this context, for purpose of brevity and clarity, detailed description of well-known devices, circuits and methods are omitted in order to avoid redundant details and possible confusion.

Various embodiments provide one or more techniques that may be used to connect display devices. According to embodiments of the present disclosure, a mixed signal including many types of signals of different properties may be received through one cable. It is possible to, through appropriate processing of such mixed signal, provide the display device with various signals for operation of the display device, which include but not limited to video signals for transmitting content to be displayed, power signals for supplying power and/or control signals for controlling display (e.g., parameter configuration) etc.

Figure 1:
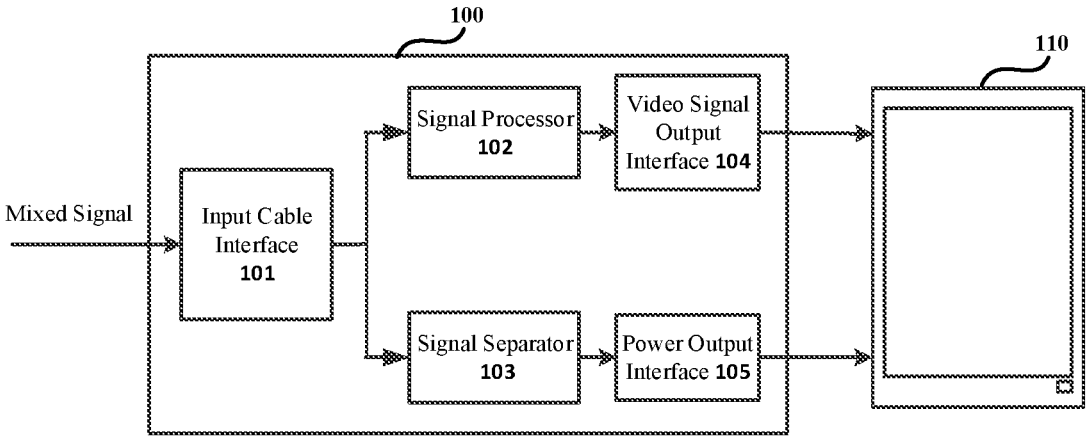
FIG. 1 shows a block diagram of an exemplary connector according to an embodiment of the present disclosure.

FIG. 1 shows a block diagram of a connector 100 according to one or more embodiments. The connector 100 is used to connect a display device 110. The connector 100 includes an input cable interface 101, a signal processor 102, a signal separator 103, a video signal output interface 104 and a power output interface 105.

The input cable interface 101 is configured to connect an input cable to receive an input mixed signal. In one embodiment, the input cable interface may be an interface for connecting an electrical cable, for example an RJ45 interface. The electrical cable may be a twisted pair, for example, a CAT-5 or CAT-6 twisted pair (shielded or unshielded). The mixed signal may comprise a plurality of different types of signals, for example it may comprise a first signal and a second signal. In some embodiments, the first signal may be a data signal and the second signal may be a power signal. As an example, the data signal may include a video signal for the content to be displayed. The video signal may be an uncompressed video signal. As another example, the data signal additionally includes a control signal for controlling display of the content. In some embodiments, the video signal and the control signal are included in the mixed signal in a form of a jointly-encoded composite signal. The control signal may be a remote-control signal such as an IR (infrared) signal or a touch signal such as a USB 2.0 signal. The power signal may be a DC voltage signal.

In some embodiments, the first signal and the second signal may be transmitted separately through different twisted pairs in the cable. In other embodiments, the first signal and the second signal may be transmitted through the same twisted pair in a multiplexed manner.

In one embodiment, the electrical cable may include two twisted pairs, and the two twisted pairs are configured to transmit a mixed signal comprising a 2K video signal for one channel, a power signal, and a control signal. In another example, the electrical cable may include four twisted pairs, and the four twisted pairs are configured to transmit a mixed signal comprising 2K video signals for two channels or a 4K video signal for one channel, a power signal and a control signal.

The signal processor 102 is configured to extract a first signal from the mixed signal and process the first signal to obtain a video signal for display by the display device. In some embodiments, the signal processor is configured to perform the processing by demodulating the first signal to obtain the video signal. In some embodiments, the control signal may also be obtained by processing (e.g., demodulating) the first signal. The signal processor may be configured to convert the obtained video signal and control signal into a LVDS or a HDMI signal. In some embodiments, the video signal may include a 4K television signal for one channel or 2K television signals for two channels. In some embodiments, the video signal may be a high definition (HD) signal or a full high definition (FHD) signal.

The video signal output interface 104 is configured to connect with the display interface of the display device 110 to output the video signal (for example, a LVDS signal or a HDMI signal) obtained by the signal processor to the display device. In one example, the video signal output interface may be a LVDS interface that may transmit a converted LVDS signal to an LVDS receiver on the display device side via for example a flexible electrical cable, for delivery to a timing controller and a row-column driving circuit in the display device to perform corresponding display. In another example, the video signal output interface may be an HDMI interface. Similarly, it may transmit a converted HDMI signal to a HDMI receiver on the display device side via an electrical cable to enable the display device to perform corresponding display.

The signal separator 103 is configured to separate the second signal from the mixed signal and generate a direct current voltage based on the second signal. In some embodiments, a DC voltage level may be any level suitable for use by the display device, such as 24V, 36V or 48V.

The power output interface 105 is configured to connect with the power supply interface of the display device 110 to output the DC voltage generated by the signal separator to the display device. In some embodiments, the output voltage and current of the power output interface may reach, for example, 48V and 2.5 A.

In some embodiments, the connector 100 may further include a control signal receiver for receiving a control signal that manipulates display of the display device. The control signal may include a remote-control signal, such as an IR signal, and/or a touch signal, such as a USB 2.0 signal. The control signal receiver may transmit the control signal to the signal processor for conversion and then output to the display device together with the video signal.

In some exemplary scenarios, the connector 100 according to embodiments of the present disclosure is mounted proximate to the display device 110 such that only two cables are needed to transmit the signal(s) and power respectively over a short distance between the connector and the display device. In some other exemplary scenarios, the connector 100 according to embodiments of the present disclosure may even be integrated into the display device 110.

It is possible to, by using a connector according to embodiments of the present disclosure to connect a display device, use one cable to simultaneously transmit to the display device various signals needed by the display device in operations, thereby reducing connection wires when mounting the display device, simplifying the installation of the display device and reducing the construction difficulty. Furthermore, since a control signal is transmitted along with the video signal by using one cable, the efficiency of later operation and maintenance of the display device is also improved.

Figure 2:
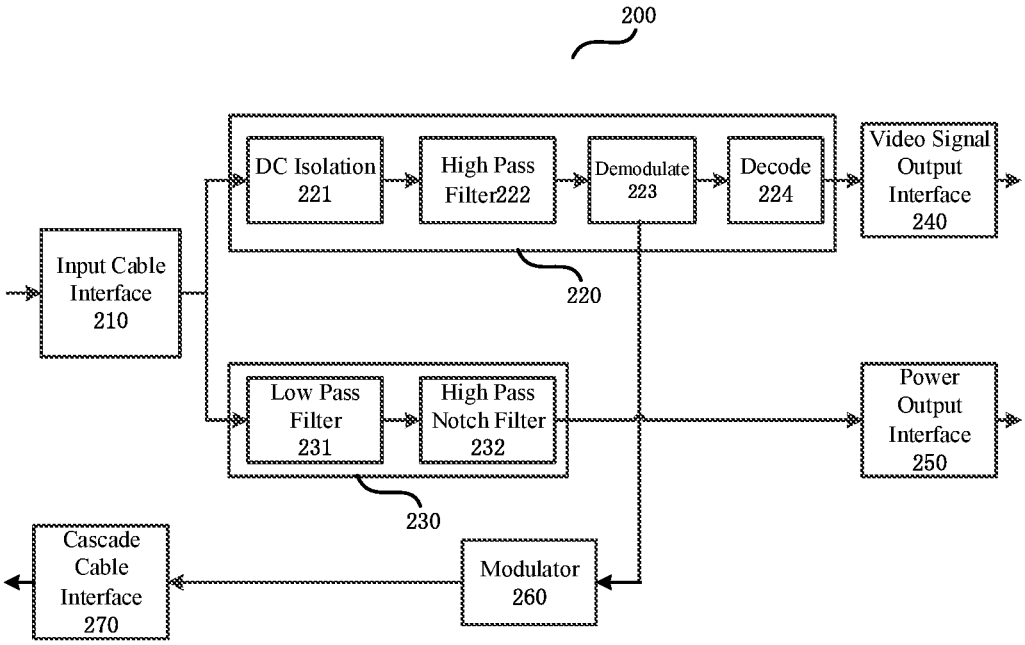
FIG. 2 shows a structural diagram of an exemplary connector according to an embodiment of the present disclosure.

FIG. 2 shows more details of an exemplary connector 200 according to an embodiment of the present disclosure. Similar to FIG. 1, the connector 200 includes an input cable interface 210, a signal processor 220, a signal separator 230, a video signal output interface 240 and a power output interface 250.

As shown in FIG. 2, the signal processor 220 includes a DC isolation circuit 221, a high pass filter 222 and a demodulator 223. The DC isolation circuit 221 is configured to perform AC coupling on the mixed signal input via the input cable interface. It is possible to isolate a DC signal (e.g., a power signal) in the mixed signal by means of AC coupling to thereby extract the first signal, for example a modulated data signal, from the mixed signal. The input of the high pass filter 222 is coupled to the output of the DC isolation circuit and the high pass filter 222 is configured to have a low-impedance conduction characteristic for the frequency of the modulated signal to further suppress a low-frequency and a DC component in the mixed signal. In some embodiments, the signal processor 220 further includes a low-pass notch filter circuit which is configured to have a characteristic of absorbing frequencies in a low frequency band (mainly, low frequency noise, etc.). A T-type network consisting of high-frequency filter and low-frequency notch filter guarantees low-impedance conduction with respect to an active signal (the active signal here refers to for example a video signal or a composite signal (including a video signal and a control signal)), and meanwhile performs effective suppression for other frequency components, especially low frequency components. The demodulator 223 is configured to demodulate the extracted digital signal to obtain a demodulated data signal. In one example, the demodulated data signal includes an uncompressed video signal. In some embodiments, the video signal in the mixed signal is an encoded and compressed signal. As such, the signal processor further includes a decoder 224 configured to, after demodulating the input mixed signal to obtain a data signal, decode the demodulated data signal to obtain the video signal. In some embodiments, the video signal and the control signal in the mixed signal exist in the form of a jointly-encoded composite signal. Thus, the signal processor may also be configured to decode the composite signal, in order to separate the video signal from the control signal.

The signal separator 230 includes a low pass filter 231 for filtering out a DC component from the mixed signal input via the input cable interface, in order to provide a DC voltage output. The low pass filter is configured to have a low-impedance conduction characteristic for frequencies in a low frequency band and a DC signal (e.g., the power signal), and meanwhile perform high-impedance suppression for a high-frequency data signal (including the video signal or composite signal). This ensures minimal attenuation of the data signal in the mixed signal, thereby reducing the interference of the data signal to the power signal and reducing the impact of noise. In some embodiments, the signal separator further includes a high-pass notch filter circuit 232 configured to have a characteristic of absorbing the frequency or frequencies of the high-frequency data signal. This allows for further absorption of high-frequency components that are not filtered away through the low pass filtering, thereby ensuring that the power signal is "clean". The T-type network consisting of the above low-pass filter and high-pass notch filter may effectively ensure the integrity of a high-frequency data signal and meanwhile ensure "cleanness" of power supply.

In some embodiments, the demodulated or decoded video signal is a fixed-format video signal. As such, the video signal output interface may include a LVDS interface which is configured to directly output the fixed-format video signal to the driving circuit of the display device.

In some embodiments, the demodulated or decoded video signal is a variable-format video signal. In this way, the video signal output interface may include a HDMI which is configured to output the variable-format video signal to an HDMI receiver, where the video signal, after undergoing corresponding conversion, is output to the driving circuit of the display device. In some embodiments, the connector may also include a format converter for converting the variable-format video signal into a fixed-format video signal. The conversion includes converting the demodulated signal (generally a TTL (transistor-transistor logic level) signal) into a fixed-format signal compatible to a screen by capturing and performing format analysis, and then performing operations such as scaling, frame rate conversion, bit jitter or compression. The fixed-format signal includes but is not limited to signals with fixed frequency and resolution such as LVDS, mini-LVDS, eDP (embedded display ports), v-by-one, etc.

In some embodiments, the connector may further include a modulator 260 and a cascade cable interface 270. The modulator 260 is configured to remodulate a demodulated video signal or a demodulated composite signal comprising a video signal and a corresponding control signal, to obtain a remodulated signal stream. The cascade cable interface 270 is configured to connect another cable to output the remodulated signal stream to another display device for corresponding display.

Figure 3:
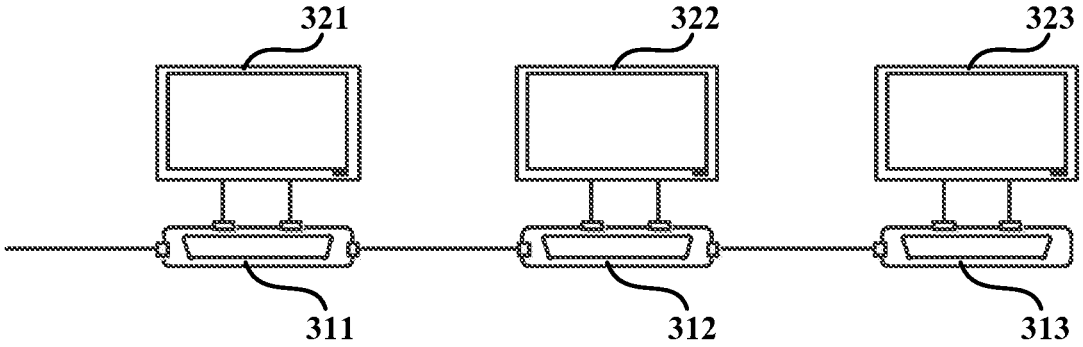
FIG. 3 shows a schematic diagram of a cascade display device according to an embodiment of the present disclosure.

In a scenario such as subway or high-speed railway station, a connector according to an embodiment of the present disclosure may enable a plurality of display devices to cascade to cooperatively display content. FIG. 3 shows a schematic diagram for cascading a plurality of display devices utilizing connectors according to an embodiment of the present disclosure.

As shown, the connectors 311, 312, 313 are connected to corresponding display devices 321, 322, 323, respectively. In the example scenario, the input cable interface of the connector 321 is connected to an input cable such as an electrical cable, for receiving an input mixed signal. The video signal output interface and the power output interface of the connector 311 are respectively connected to the video signal input interface and the power input interface of the display device 321 to provide the display device 321 with the video signal (additionally, the control signal) and power signal obtained from the mixed signal. In an example, the video signal may be an uncompressed video signal. At the same time, the cascade cable interface of the connector 311 is connected to the input cable interface of the connector 312 via, for example, an electrical cable to provide the connector 312 with a mixed signal in which the video signal is mixed with the power signal. The video signal output interface and the power output interface of the connector 312 are respectively connected with the video signal input interface and the power supply input interface of the display device 322 to provide the display device 322 with the video signal obtained from the mixed signal and optionally with the power signal. The connector 313 is similarly connected to the connector 312 to provide the display device 323 with the video signal obtained from the mixed signal and optionally with the power signal.

With a connector according to an embodiment of the present disclosure, the display device may be conveniently cascaded, thereby alleviating wiring requirements when a plurality of display devices are mounted. At the same time, it is possible to achieve update and maintenance of the displayed content through simple control of a signal from the signal source, which reduces the burden in operation and maintenance, and also greatly reduces the failure rate.

Figure 4:
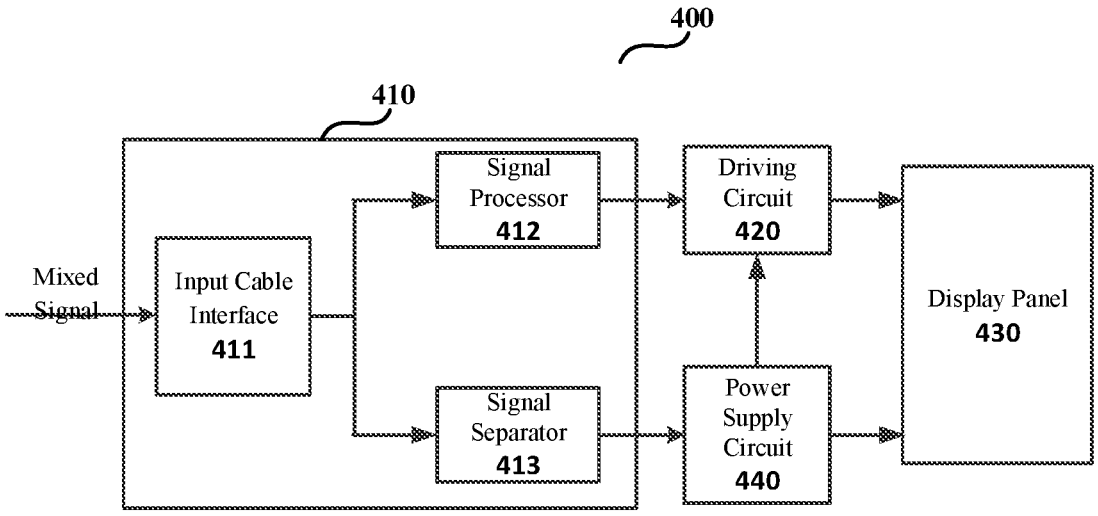
FIG. 4 shows a block diagram of an exemplary display device according to an embodiment of the present disclosure.

FIG. 4 shows a block diagram of an exemplary display device 400 according to an embodiment of the present disclosure. As shown in FIG. 4, the display device includes a cable connection circuit 410, a driving circuit 420, a display panel 430 and a power supply circuit 440.

The cable connection circuit 410 includes an input cable interface 411, a signal processor 412 and a signal separator 413. The input cable interface 411 is configured to connect an input cable to receive an input mixed signal. In one embodiment, the input cable interface 411 may be an interface for connecting an electrical cable, for example an RJ45 interface. The electrical cable may be a twisted pair, for example, a CAT-5 or CAT-6 twisted pair etc. The mixed signal may comprise a plurality of different types of signals, for example it may comprise a first signal and a second signal. In some embodiments, the first signal may be a data signal and the second signal may be a power signal. In one example, the data signal may include a video signal for the content to be played, and optionally include a control signal for controlling play of the content. The video signal may be an uncompressed video signal. In some embodiments, the data signal may be a composite signal formed by jointly encoding the video signal and the control signal. The control signal may be a remote-control signal or a touch control signal. The power signal may be a DC voltage signal.

The signal processor 412 is configured to process the first signal to obtain a video signal for display by the display device. In some embodiments, the video signal in the mixed signal is an encoded and compressed signal. As such, the signal processor 412 is further configured to, after the input mixed signal is demodulated to obtain the digital signal, decode the demodulated data signal to obtain the video signal. In some embodiments, the video signal and the control signal in the mixed signal are jointly encoded into a composite signal. As such, the signal processor may also be configured to decode the composite signal to separate the video signal from the control signal. In some embodiments, the signal processor may convert the obtained video signal and control signal into a LVDS, a HDMI signal, or the like.

The signal separator 413 is configured to separate the second signal from the mixed signal and generate a DC voltage based on the second signal. In some embodiments, the DC voltage level may be any level suitable for use by a display device, such as 48V.

The driving circuit 420 is coupled to the output of signal processor 412 to receive the video signal and/or composite signal (including the video signal and control signal) obtained by the signal processor 412. In some embodiments, the LVDS signal from the signal processor 412 may be directly input to a timing controller in the driving circuit. The driving circuit 420 may process the video signal and/or the composite signal to generate a driving signal for display of the display panel based thereon.

The display panel 430 is configured to display an image(s) according to the driving signal generated by the driving circuit.

The power supply circuit 440 is coupled to the output of the signal separator 413 to receive the DC voltage it supplies. The power supply circuit may transform the DC power supply to supply an applicable DC voltage (e.g., 5V, 12V, 24V, 48V, etc.) to various components in the display device, such as a driving circuit and a display panel. In some embodiments, the power supply circuit further provides an applicable DC voltage to a backlight panel in the display device so that the backlight panel transforms it into high-frequency high-voltage AC, to light up a backlight lamp of the display panel.

Figure 5:
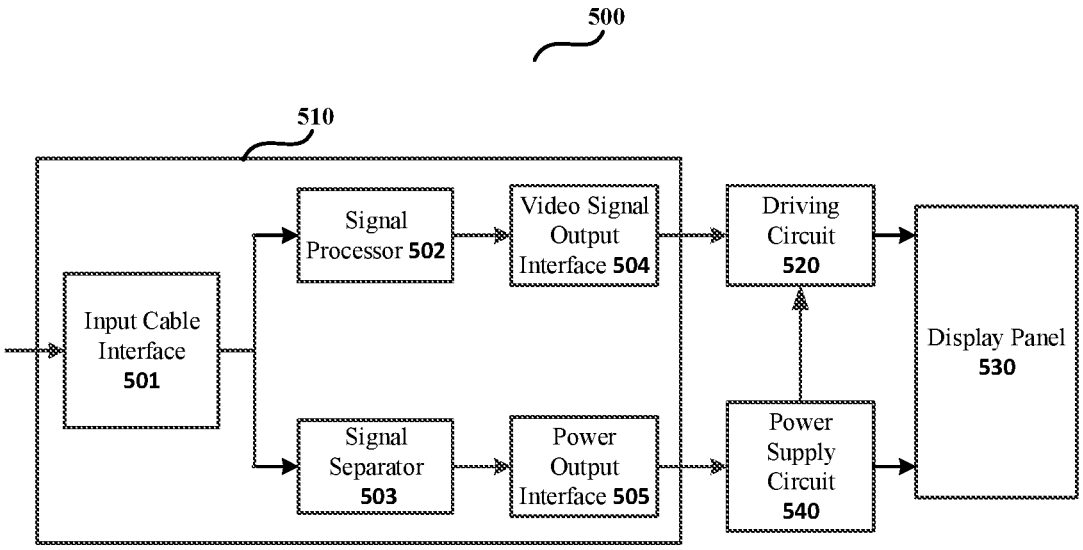
FIG. 5 shows a block diagram of another exemplary display device according to an embodiment of the present disclosure.

FIG. 5 shows another exemplary display device 500 according to an embodiment of the present disclosure. The display device 500 may include a connector 510 according to an embodiment of the present disclosure, for example the connector described above with reference to FIGS. 1 and 2. In such an embodiment, the display device 500 includes the connector 510, a driving circuit 520, a display panel 530 and a power supply circuit 540. Similar to the connector shown in FIG. 1, the connector 510 may include an input cable interface 501, a signal processor 502, a signal separator 503, a video signal output interface 504 and a power output interface 505. The driving circuit 520 may receive a video signal from the video signal output interface 504 and generate a driving signal for display of the display panel based thereon. In one example, the video signal may be an uncompressed video signal. The power supply circuit 540 may receive the DC voltage supplied by the power output interface 505 and transform the DC voltage to supply power to the display device 500.

In some embodiments, the display device may be an LCD (Liquid Crystal Display) device, an LED device, or the like. In some embodiments, the display device may be applied to ultra-thin digital signage, strip screens and double-sided displays, etc. In some embodiments, the display device may be mounted in an area such as outdoor or corner.

With a display device according to embodiments of the present disclosure, connection wires for mounting a display device are reduced by using one cable to simultaneously receive a power signal and a video signal. In this way, the mounting of the display device is simplified, construction difficulty is reduced, and the efficiency of the later operation and maintenance is improved. At the same time, an ultra-light and ultra-thin design purpose is achieved by deeply integrating signal, control, as well as T-CON, liquid crystal driving and backlight driving in the display device.

The use of "exemplary" in the text herein is intended to serve as an example, instance, illustration, etc., and is not necessarily advantageous. Furthermore, at least one of A and B and/or similar expressions generally mean A or B or both A and B. In addition, regarding terms "includes", "having", "has", "with" and/or variants thereof used in the embodiments or the claims, such terms are intended to be inclusive in a manner similar to the term "comprising".

Various aspects of the present disclosure may be used individually, in combination, or in diverse arrangements not specifically discussed in the above-described embodiments, and therefore, use thereof is not limited to details and arrangements of parts illustrated in the above description or shown in figures. For example, some aspects described in one embodiment may be combined with certain aspects described in other embodiments in any manner.

The invention claimed is:

1. A connector for a display device, comprising:

an input cable interface configured to connect to an input cable and configured to receive a mixed signal, the mixed signal comprising a data signal and a DC voltage signal that are transmitted through a same twisted pair in the input cable;

a signal processor configured to process the data signal in the mixed signal received via the input cable interface to obtain a video signal for display by the display device;

a signal separator comprising a low pass filter, configured to separate the DC voltage signal from the mixed signal received via the input cable interface and to generate a DC voltage based on the DC voltage signal;

a video signal output interface configured to connect to a display interface of the display device and configured to output the video signal obtained by the signal processor to the display device; and a power output interface configured to connect to a power supply interface of the display device and configured to output the DC voltage generated by the signal separator to the display device, wherein the signal processor comprises a DC isolation circuit configured to isolate the DC voltage signal in the mixed signal from the input cable interface to separate the data signal therefrom.

2. The connector according to claim 1, wherein the data signal further comprises a control signal for controlling display of the display device, and wherein the signal processor is further configured to process the data signal to separate the video signal from the control signal.

3. The connector according to claim 2, wherein the data signal comprises a modulated data signal, and the signal processor comprises:

a high pass filter comprising a low-impedance conduction characteristic for a frequency of the modulated data signal, wherein the high pass filter is configured to perform high pass filtering on the separated modulated data signal to obtain a high-pass filtered modulated data signal; and a demodulator configured to demodulate the high-pass filtered modulated data signal to obtain a demodulated data signal.

4. The connector according to claim 2, wherein the video signal comprises a fixed-format video signal, and wherein the video signal output interface comprises a low voltage differential signaling (LVDS) interface which is configured to output the fixed-format video signal directly to a driving circuit of the display device.

5. The connector according to claim 2, wherein the video signal comprises a variable-format video signal, and wherein the video signal output interface comprises a high definition multimedia interface (HDMI) interface which is configured to output the variable-format video signal to the display device.

6. The connector according to claim 1, wherein the data signal comprises a modulated data signal, and the signal processor comprises:

a high pass filter comprising a low-impedance conduction characteristic for a frequency of the modulated data signal, wherein the high pass filter is configured to perform high pass filtering on the separated modulated data signal to obtain a high-pass filtered modulated data signal; and a demodulator configured to demodulate the high-pass filtered modulated data signal to obtain a demodulated data signal.

7. The connector according to claim 6, wherein the data signal comprises an encoded video signal, and wherein the signal processor further comprises a decoder configured to decode the demodulated data signal to obtain the video signal.

8. The connector according to claim 6, further comprising:

a modulator configured to remodulate the demodulated data signal to obtain a remodulated data signal; and a cascade cable interface configured to connect another cable to output the remodulated data signal to another display device.

9. The connector according to claim 1, wherein the video signal comprises a fixed-format video signal, and wherein the video signal output interface comprises a low voltage differential signaling (LVDS) interface which is configured to output the fixed-format video signal directly to a driving circuit of the display device.

10. The connector according to claim 1, wherein the video signal comprises a variable-format video signal, and wherein the video signal output interface comprises a high definition multimedia interface (HDMI) interface which is configured to output the variable-format video signal to the display device.

11. The connector according to claim 1, wherein the input cable comprises an electrical cable, and wherein the electrical cable comprises a CAT-5 or CAT-6 twisted pair.

12. The connector according to claim 1, wherein the video signal comprises an uncompressed video signal.

13. A display device, comprising a driving circuit, a display panel, a power supply circuit and a connector according to claim 1, wherein the driving circuit is configured to receive a video signal from the video signal output interface and generates a driving signal for display of the display panel based on the video signal; and wherein the power supply circuit is configured to receive the DC voltage supplied by the power output interface and transforms the DC voltage to supply power to the display device.

14. The display device according to claim 13, wherein the data signal comprises a modulated data signal, and the signal processor comprises:

a high pass filter comprising a low-impedance conduction characteristic for a frequency of the modulated data signal, wherein the high pass filter is configured to perform high pass filtering on the separated modulated data signal to obtain a high-pass filtered modulated data signal; and a demodulator configured to demodulate the high-pass filtered modulated data signal to obtain a demodulated data signal.

15. The display device according to claim 13, wherein the video signal comprises a fixed-format video signal, and wherein the video signal output interface comprises a low voltage differential signaling (LVDS) interface which is configured to output the fixed-format video signal directly to a driving circuit of the display device.

16. The display device according to claim 13, wherein the video signal comprises a variable-format video signal, and wherein the video signal output interface comprises a high definition multimedia interface (HDMI) interface which is configured to output the variable-format video signal to the display device.

17. A display device, comprising a driving circuit, a display panel and a power supply circuit, the display device further comprising:

an input cable interface configured to connect to an input cable to receive a mixed signal, the mixed signal comprising a data signal and a DC voltage signal that are transmitted through a same twisted pair in the input cable;

a signal processor configured to process the data signal in the mixed signal received via the input cable interface to obtain a video signal for display by the display device; and a signal separator comprising a low pass filter, configured to separate the DC voltage signal from the mixed signal received via the input cable interface and to generate a DC voltage based on the DC voltage signal, wherein the driving circuit is configured to receive the video signal from the signal processor and generates a driving signal for display of a display panel based on the video signal, wherein the power supply circuit receives the DC voltage generated by the signal separator and transforms the DC voltage to supply power to the display device; and wherein the signal processor comprises a DC isolation circuit configured to isolate the DC voltage signal in the mixed signal from the input cable interface to separate the data signal therefrom.

* * * * *